US005297383A

United States Patent [19]

Mackay

[11] Patent Number: 5,297,383

[45] Date of Patent: Mar. 29, 1994

[54] FILE CLIP, APPARATUS AND INSTALLATION METHOD

[75] Inventor: George R. Mackay, Queensland, Australia

[73] Assignee: Binda Nominees Pty Ltd., Queensland, Australia

[21] Appl. No.: 768,215

[22] PCT Filed: Mar. 13, 1990

[86] PCT No.: PCT/AU90/00097

§ 371 Date: Oct. 11, 1991

§ 102(e) Date: Oct. 11, 1991

[87] PCT Pub. No.: WO90/10768

PCT Pub. Date: Sep. 20, 1990

[30] Foreign Application Priority Data

Mar. 13, 1989 [AU] Australia ..... PJ3149
Jul. 25, 1989 [AU] Australia ..... PJ5440

[51] Int. Cl.[5] ..... E04B 1/38

[52] U.S. Cl. ..... 52/712; 52/547

[58] Field of Search ..... 52/546, 547, 548, 549, 52/550, 357, 358, 359, 360, 361, 712

[56] References Cited

U.S. PATENT DOCUMENTS

| | | | |
|---|---|---|---|
| 757,285 | 4/1904 | Duchemin | 52/550 |
| 1,399,315 | 12/1921 | Ocampo | 52/548 |
| 1,537,952 | 9/1922 | Kridler et al. . | |
| 1,576,423 | 3/1926 | Fulenwider et al. | 52/547 |
| 1,579,715 | 2/1923 | Kridler et al. . | |
| 1,593,408 | 7/1926 | Honigbaum | 52/548 |
| 2,152,080 | 3/1939 | Munsey | 52/546 |
| 4,074,353 | 9/1977 | Aarons . | |
| 4,106,253 | 8/1978 | Aarons . | |

FOREIGN PATENT DOCUMENTS

| | | | |
|---|---|---|---|
| 535929 | of 1955 | Belgium | 52/549 |
| 3507460 | of 0000 | Fed. Rep. of Germany . | |
| 2502219 | of 0000 | France . | |
| 2508519 | of 0000 | France . | |
| 2508520 | of 0000 | France . | |
| 2584759 | of 0000 | France . | |
| 486509 | of 1918 | France | 52/547 |
| 567640 | of 0000 | Switzerland . | |
| 1174891 | of 0000 | United Kingdom . | |
| 1427022 | of 0000 | United Kingdom . | |
| 1514723 | of 0000 | United Kingdom . | |
| 2213512 | of 0000 | United Kingdom . | |
| 10328 | of 1898 | United Kingdom | 52/547 |

*Primary Examiner*—Ramon S. Britts
*Assistant Examiner*—Joanne C. Downs
*Attorney, Agent, or Firm*—Larson and Taylor

[57] ABSTRACT

A roofing tile clip and apparatus and installation method thereof. The clip comprises a rigid body (2) from which extends at least one, preferably two, securing members (3), (11) and a fastening member (6). Each securing member comprises a shank portion (4), (12) termination in a shaped hook (5), (60). The fastening member comprises a short shank portion (7) bent orthogonally approximately at its mid-length, this orthogonal portion being crimped and having one edge thereof shaped to form a barb (9). Rows of clips are affixed at spaced intervals along the length of the individual battens and the roofing tiles are engaged along their edge portions by the hooks (5), (60). The clips are preferably affixed to the battens by a clip-driving machine connected to an apparatus for accurately positioning the clips, the apparatus comprising a channel section (100)—adapted to rest on and slide along a batten—and an outrigger (114) extending at right angles thereto and adapted to be supported at its other end by an adjacent roofing batten. A U-shaped opening (116) is provided at the junction of the outrigger (114) and channel section (100) and a clip-driving machine is secured to the outrigger (114) with the clip-locating head being arranged in the U-shaped opening (116). Various means are provided for accurately positioning the apparatus including an abutment (112) or a spring-loaded tongue (123) and latch (124) or a pivoting arm (901).

23 Claims, 8 Drawing Sheets

FILE CLIP, APPARATUS AND INSTALLATION METHOD

TECHNICAL FIELD

This invention relates to a clip for attaching tiles of a roof to battens or the like and to an apparatus and method for the installation thereof.

BACKGROUND ART

A method often employed for the installation of concrete roof tiles comprises placing a tile in position so as to overlay two spaced apart roofing battens, fitting a clip to the profiled edge of the tile adjacent one of the battens, and nailing the clip to the side of the batten directly beneath the clipped edge of the tile.

A preferred clip for such a method is described in Australian Patent No. 520403 which discloses a tile clip having a rigid body having a pair of outwardly extending hooks for engagement with adjacent edge portions of an upper tile and of a lower tile of a pair of overlapping roof tiles. Each of the hooks are located on a common side of the rigid body. Fastening means are included which comprise one or a pair of opposed downwardly extending lugs having a plurality of barbs for penetration into an adjacent surface of a tiling batten. The or each lug depends from an elongate flange which is part of the rigid body wherein the flange is oriented at right angles to each hook and an intermediate web located therebetween.

This prior tile clip suffers from a number of disadvantages, including (1) a tendency to rotate or deflect under an applied load and thus can not be used advantageously in situations subject to relatively inclement or extreme weather conditions such as heavy winds; (2) the clip can only be installed using a hammer or other form of impact tool and thus the speed of installation is relatively slow and can only be carried out effectively by an experienced tradesman; (3) the clip can only be produced from relatively heavy grade metal and thus is relatively expensive to manufacture; (4) its installation is time consuming, tiring and subject to error as the tradesman must continually and in sequence, lift and place a tile, pick up a clip and hammer, locate the clip and hammer it home, and then put the hammer down before repeating the process.

This prior installation method is of particular concern because the method is tiring not only because of the repetition, but also because of the awkward position required to nail the clip. Errors occur with tile breakages because the clip is required to be nailed immediately adjacent the tile edge and any small deflection can result in the tile being hit. Additionally, and more importantly, it is not uncommon for the clip to be nailed at a location away from the edge of the tile in order to reduce breakages and speed up the tiling. However, this results in a significantly weakened roof structure which often does not comply with the relevant government safety standards.

DISCLOSURE OF THE INVENTION

It is an object of the invention to overcome, or at least ameliorate, one or more of the above disadvantages.

According to a first aspect of the present invention, there is provided a clip for attaching a roof tile or the like to a batten or similar, said clip comprising:

1) a rigid body;

2) at least one securing member depending from said rigid body in a first direction and adapted to engage a side edge of at least one of said tile or the like; and 3) a fastening member depending from said rigid body in a second direction opposite to said first direction and adapted to secure said clip to said batten or similar.

When staggered bonding of a plurality of said tile or the like is required, only one of said at least one securing member is required; when straight bonding is required, two of said at least one securing member are required.

Preferably, each of said at least one securing member comprises a shank portion terminating in a hook, said hook having a profile which is complementary to the profile of said side edge of said tile or the like. When the second of said securing member is present, its shank portion is shorter so that its corresponding said hook can engage the side edge of a second of said tile which is positioned lower than a tile secured by the first of said securing member.

More preferably, each hook comprises a web part suitably oriented at between 30° and 60° to the horizontal, most preferably at 45°, abuting or bearing against the face of a ridge of said tile and a U-shaped portion abuting or bearing against the inner face of said ridge.

Preferably, said fastening member comprises a short shank portion bent orthogonally approximately at its mid-length, this orthogonal portion being crimped and having one edge thereof shaped to form a barb or the like for penetration into said batten when the opposite edge of said one edge is impacted by a hammer or other suitable impact tool or alternatively driven home by an apparatus as described hereinafter.

According to a second aspect of the present invention there is provided a method of installation of the clip as defined above, said method comprising:

(1) attaching a plurality of said clip as hereinbefore defined to a first tiling batten at spaced intervals thereof along the length of the batten;

(2) subsequently laying a first row of tiles which are each supported by said first batten and wherein each tile is retained in position by one of said securing member;

(3) attaching a plurality of said clip to a second tiling batten at spaced intervals thereof along the length of the batten, said second tiling batten being oriented substantially parallel to said first tiling batten;

(4) subsequently laying a second row of tiles which are each supported at one end by said second batten and at the other end by said first row of tiles;

(5) repeating the above-defined steps as necessary to affix all required rows of tiles;

wherein:

if only one of said securing member is present, one of said clip is required for each tile to be secured; or;

if two of said securing member are present, each tile of said first row is secured by the first of said securing member and each tile of said second row is secured by the second of said securing member.

According to a third aspect of the present invention, there is provided an apparatus for use in the installation of a roof tile clip or the like to a batten or similar, said appratus comprising:

1) a first section adapted to engage and be supported by a first batten; and 2) a second section attached at one end to said first section and adapted at the other end to engage and be supported by a second batten adjacent and substantially parallel to said first batten;

wherein said second section is adapted to support a clip-driving machine in a location enabling said clip to be driven into said first batten.

Preferably, said first section comprises a channel section adapted to straddle said first batten, and said second section comprises an outrigger arranged to extend from said channel section to overlie said second batten, said channel section having at least one of its flanges cut away between its ends on the side from which the outrigger extends to form a recess, and said outrigger being designed to support said clip-driving machine in a location enabling clips to be driven into said first batten through said recess.

Preferably, said outrigger comprises a substantially flat plate formed integrally with the top surface of said channel section of substantially overall rectangular configuration with appropriate strengthening ribs to prevent buckling under the weight of the clip-driving machine, the length of the outrigger being such that it is adequately supported by the second or adjacent roofing batten and is readily slidable thereover.

More preferably, the strengthening ribs comprise edge portions which extend downwards at right angles to the plane of the plate.

Most preferably, at the junction of the outrigger and channel section, the outrigger includes a recessed portion, which is preferably substantially U-shaped when viewed from above, with the driving mechanism of said machine being located on one arm or side of the U and the batten to which the clip is to be attached being located directly beneath the other arm of the U.

Other preferred and/or optional features of said apparatus include:

1) a cut-away in the web of the channel section adjacent to said cut-away in the flange, extending for the same distance as said cut-away in the flange but of only minimal depth; this cut-away ensures that the clip does not catch on the side of the channel section when the apparatus is being slid to a second driving location and/or to provide an abutment edge for aligning the apparatus with the correct second driving location;

2) as an alternative to said abutment edge, a retractable stop may be included adjacent the end of the channel section remote from the location of the clip-driving machine, comprising a plunger member which is normally spring-biased to extend from a housing fitted to the top surface of the channel section substantially at right angles to the said channel section with an associated button or lever which may be activated to withdraw the plunger into the housing so that it does not extend past the flange of the channel section, thereby permitting the apparatus to be slid past a clip to its next clip-driving location;

3) as a first alternative to either said cut-away in the web of the channel section or said retractable stop, a pivotable arm may be provided adjacent the end of the channel section remote from the clip-driving machine, whereby said pivotable arm is constrained to pivot in only one direction whereupon contact with a driven clip causes the arm to pivot upwards enabling the apparatus to be slid past the clip and engagement of the arm with the other side of the driven clip provides a rigid abutment for accurate placement of the apparatus to ensure essentially equi-distance between successive driven clips;

4) as a second alternative to either said cut-away in the web of the channel section or said retractable stop, a locating member may be provided as part of, or adjacent to, the end of the channel section remote from the location of the clip-driving machine, said locating member including a stop comprising a removable pre-set positioning member which readily allows the distance between successive clips to be varied according to a predetermined spacing; the positioning member could, for example, include a removable saddle comprising at least two slots which provide at least two possible positions for the clip-driving machine before the next clip is driven home;

5) in order to facilitate movement of the apparatus over and along a roofing batten, the leading edge of the channel section may include a flared end, thereby permitting any burrs, knots or other timber deformations to be smoothly passed over without interruption; at or near the flared end, there may also be an adjusting means which allows the height of the channel section above the batten to be varied to allow for the slight variations in depth of adjacent tiles as the apparatus is moved along a batten;

6) a location line comprising a marking, indentation or appendix is suitably included on the upper web surface of the channel section for the purpose of accurately positioning the apparatus on the following roofing batten, that is, the roofing batten which is to be clipped next; this location line is intended to line up with a marking, for instance, a pencil marking, made on the batten at the beginning of a run; the marking is initially made against a scribe edge of the outrigger which overlaps the batten which is next to be clipped; preferably, a notch, such as a V-notch, is formed adjacent the location line in the web of the channel section located slightly rearward of the clipping station;

7) a clamping means may also be provided which secures the channel section to the batten to avoid excessive movement of the apparatus when each clip is driven home;

8) the channel section could be replaced by, for example, a right-angle section or by a flat section with batten aligning and retaining means suitably positioned thereon.

The clip-driving machine which the outrigger is adapted to support may be any machine suited for the purpose. The machine may be fitted to the outrigger by bolts, screws or like releasable fastening means, or may be welded or otherwise formed integrally therewith. To this end, the profile of the outrigger will be conformed to suit the particular shape and size of the clip-driving machine with which it is to be used.

However, the clip-driving machine is preferably designed to separately drive a tile clip from a plurality of stacked tile clips stored in a cartridge.

More preferably, the clip-driving machine is designed to drive a clip as hereinbefore defined.

The clip-driving machine may be an adaptation of an automatic high powered stapler, for example, a stapler with a modified head portion to accommodate the particular design of clip and cartridge, or it may be a specially designed clip driver. However, the basic features of the clip driving machine preferably include a housing for a pneumatic cylinder adapted for connection to a source of compressed air, a triggering system, and a cartridge. The triggering system should comprise a handle release which actuates the removal of a clip from its stack within the cartridge and permits alignment with a driving position and then the subsequent driving of the clip into the side of the roofing batten. The cartridge will be such as to contain a plurality of stacked tile clips which are preferably bonded together in the cartridge and are separated just before being driven into the roofing batten. This bonding may be by simple mechanical bonding of adjacent clips or may be by the use of a resin adhesive. Any resin adhesive may include suitable additives which also aid in the bonding of the clip to the batten.

DETAILED DESCRIPTION OF EMBODIMENTS

Preferred embodiments of the present invention will now be described with reference to accompanying drawings wherein.

Figure 1:
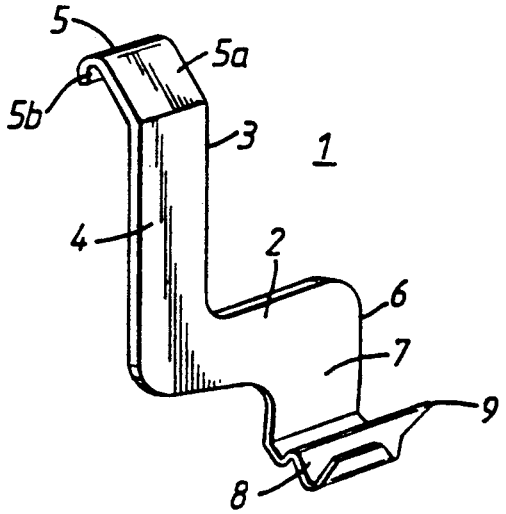
FIG. 1 is a perspective view of a single first clip constructed in accordance with the present invention.
Figure 2:
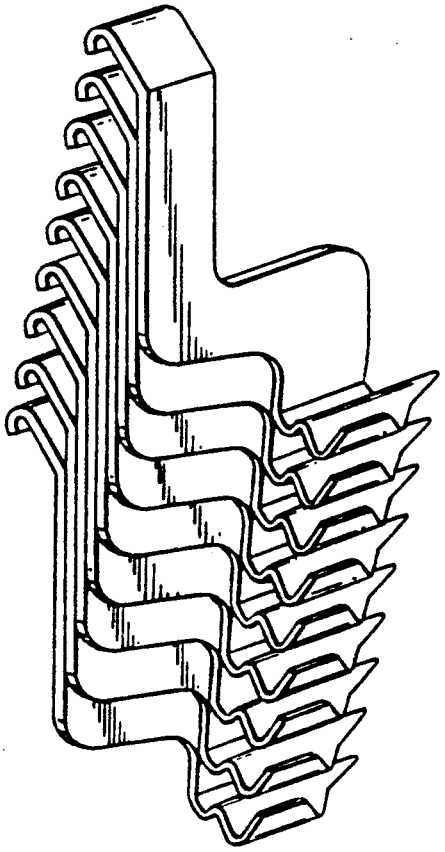
FIG. 2 is a perspective view of a plurality of the clip illustrated in FIG. 1 in stacked relationship.

When staggered bonding of the tiles is required, the clip (1) as illustrated in FIG. 1 is necessary. The clip (1) comprises a rigid body (2). A securing member (3) comprises a shank (4) depending from the rigid body (2) and terminating in a shaped hook (5). The hook (5) comprises a web portion (5*a*) oriented at approximately 45° to the shank (4) and ends with a U-shaped portion (5*b*). A fastening member (6) extends in a direction opposite to the securing member (3) and comprises a short shank portion (7) which is bent orthogonally approximately at its mid-length to form a short member (8). An outer edge of the short member (8) is tapered to form a barb (9) and the entire short member (8), including the barb (9), is crimped to impart further rigidity and strength to the fastening member (6). The rigid body (2), the shank (4) of the securing member (3) and the shank portion (7) essentially lie in a common plane. The dimensions and relative orientation of the individual features of the clip (1) are chosen such that the clip (1) can be stacked as illustrated in FIG. 2.

Figure 3:
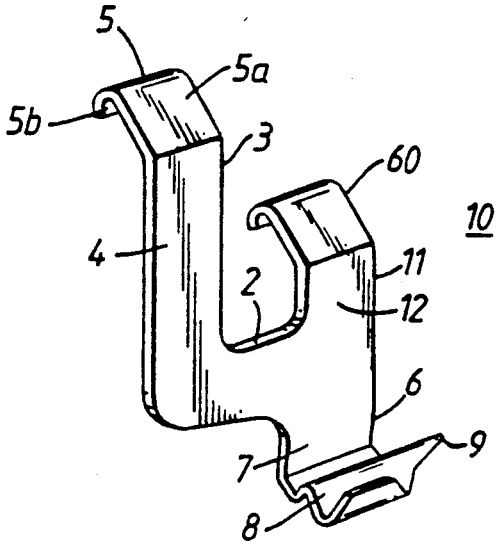
FIG. 3 is a perspective view of a single second clip constructed in accordance with the present invention.
Figure 4:
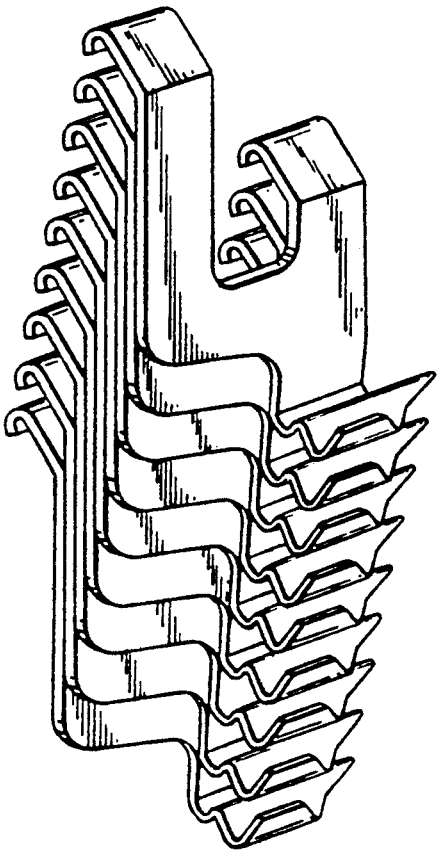
FIG. 4 is a perspective view of a plurality of the clip illustrated in FIG. 3 in stacked relationship.

When straight bonding of the tiles is required, a clip (10) as illustrated in FIGS. 3 and 4 is required, wherein the rigid body (2), securing member (3), hook (5) and fastening member (6) are all as described with reference to FIGS. 1 and 2. A second securing member (11) depends from the rigid body (2) separated from the securing member (3) and comprises a shank portion (12), which is shorter than the shank portion (4) of the securing member (3) but terminates in a shaped hook (60) which is identical in shape to hook (5). The dimensions and relative orientation of the clip (10) are choosen such that the clip (10) can be stacked as illustrated in FIG. 4.

The clips (1) or (10) are preferably stacked in bundles of about 25. Such bundles can be readily loaded into a cartridge of a suitable clip-driving machine. The clips are suitably adhered together by any adhesive commonly used to adhere nails together for use in nail guns.

Figure 5:
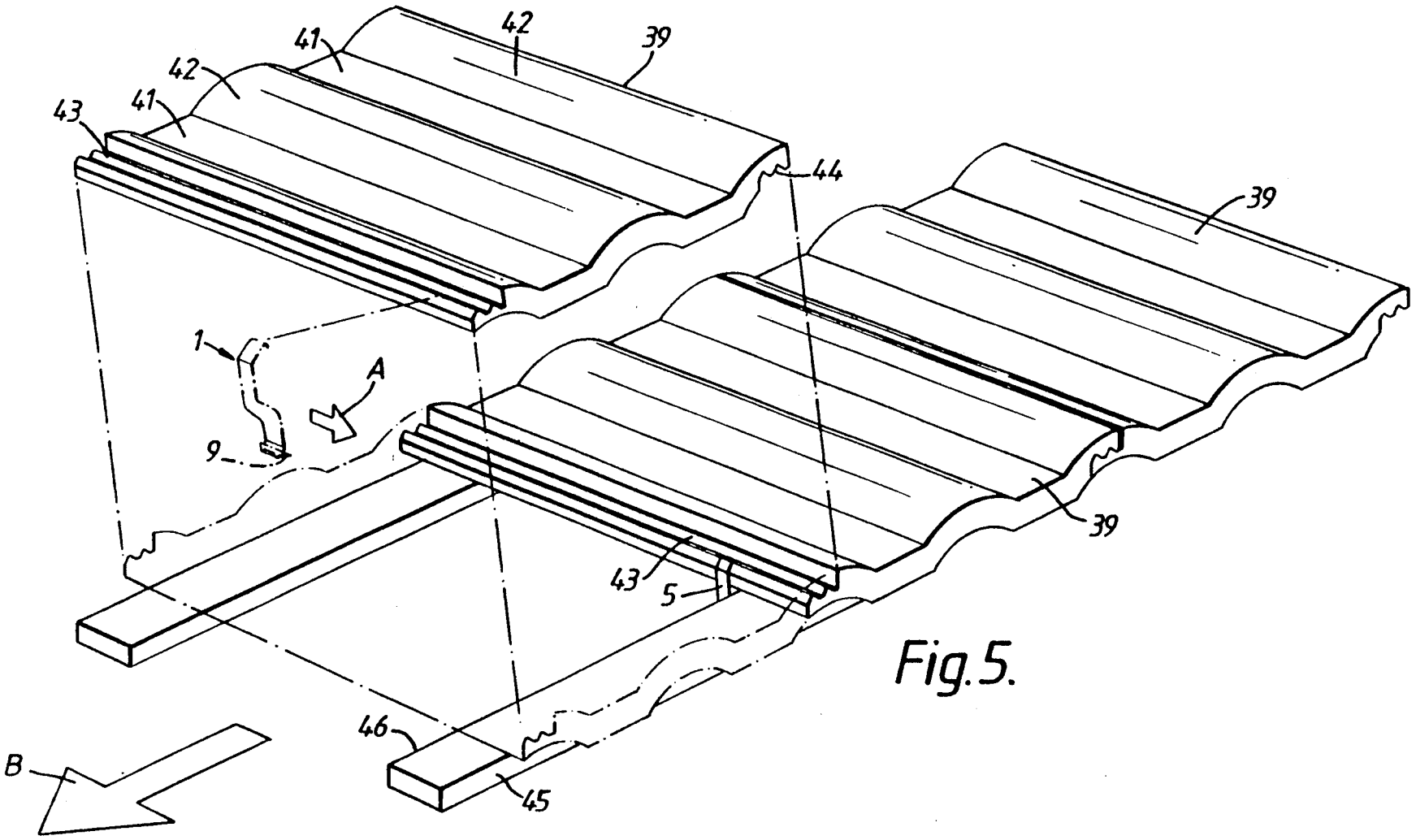
FIG. 5 is a perspective view illustrating the method of use of the clip of FIG. 1.

In the method of use of the clip (1) as shown in FIG. 5, tiles (39) include corrugation valleys (41) and corrugation hills (42) and edge portions (43) and (44) which are complementary to each other as shown so as to mate securely. Clips (1) are driven into one edge surface (46) of batten (45) as shown wherein the hook (5) may engage securely with edge portion (43) of a tile (39), hook (5) being of complementary shape to edge (43). Attachment barb (9) may be driven into surface (46) by a hammer or other suitable impact tool (not shown).

The arrow B represents the direction of the row of tiles being laid and the arrow A represents the direction of movement of the hammer or other suitable impact tool in forcing clips (1) shown initially in phantom into surface (46) of batten (45).

Figure 6:
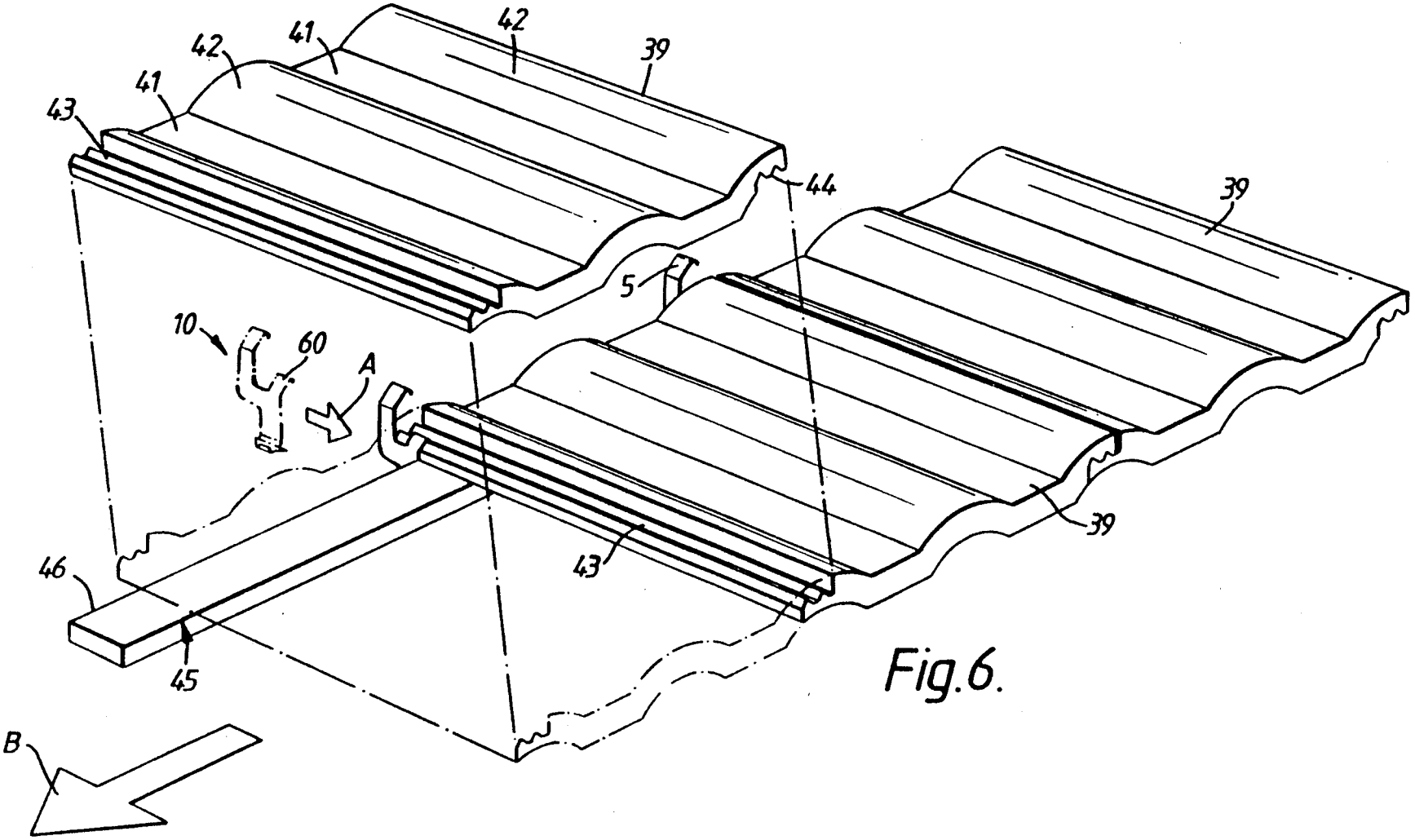
FIGS. 6 and 7 are perspective views illustrating the method of use of the clip of FIG. 3.
Figure 7:
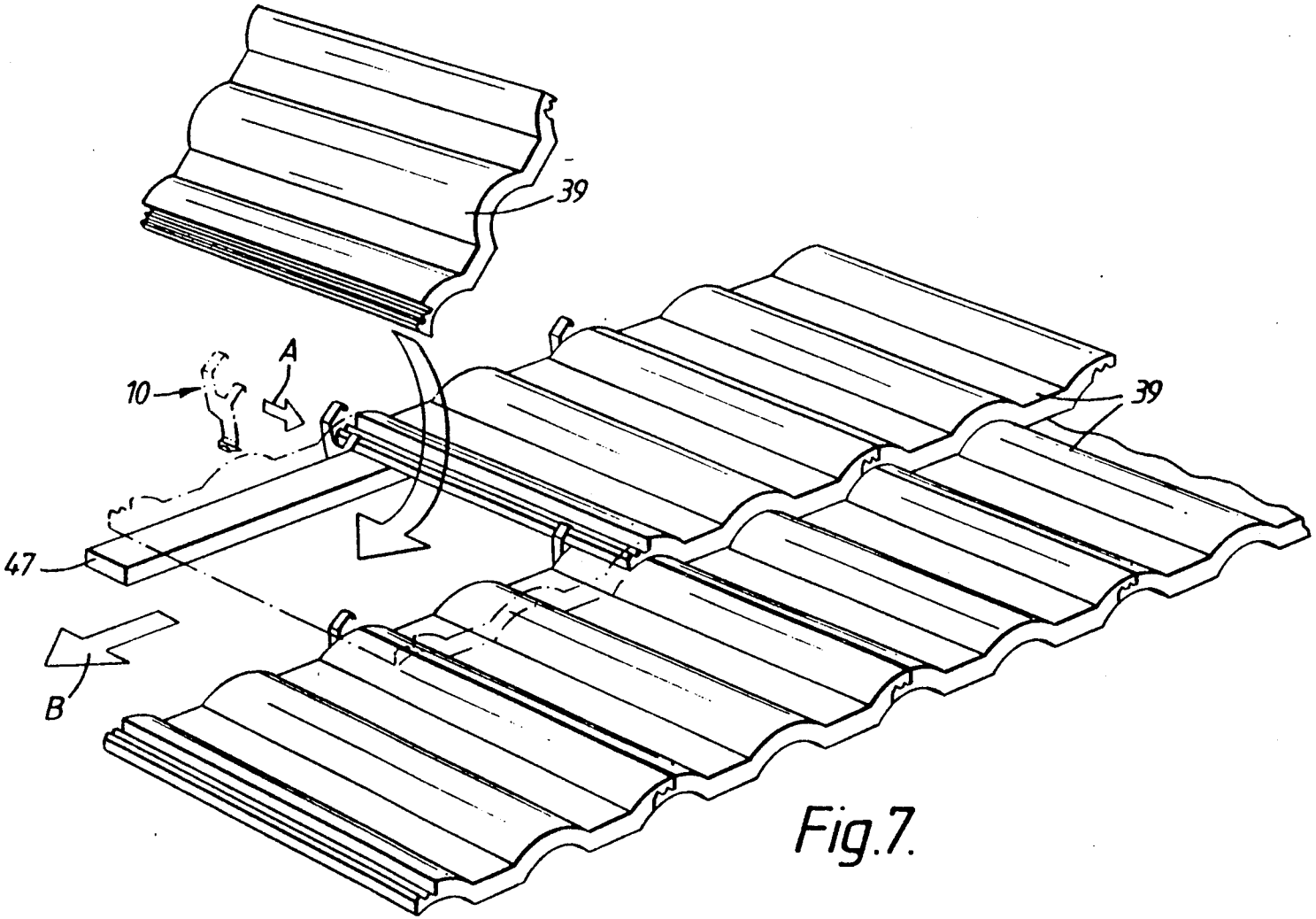

In the method of use of the clip (10) as shown in FIGS. 6 and 7, tiles (39) include corrugation valleys (41) and corrugation hills (42) and edge portions (43) and (44) which are complementary to each other as shown so as to mate securely. Clips (10) are driven into one edge surface (46) of batten (45) as shown wherein the shorter hook (60) may engage securely with edge portion (43) of a tile (39), hook (60) being of complementary shape to edge (43). Attachment barb (9) may be driven into the edge surfaces by a hammer or other suitable impact tool (not shown).

In FIG. 7 a second row of tiles (39) is shown being laid supported by a second tiling batten (47). It will be noted that the longer hooks (5) of clips (10) attached to batten (47) may then be used to engage with edge portions (43) of the second row of tiles adjacent a leading end as shown. Clips (10) are driven into batten (47) with short hooks (60) engaging with edge portions (43) of the second row of tiles adjacent a trailing end as shown.

Figure 8:
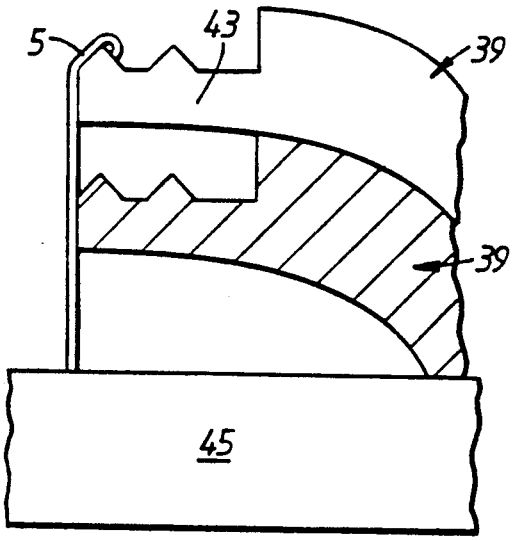
FIG. 8 is a side sectional view of the clip of FIG. 1 engaging with a pair of adjacent tiles.
Figure 9:
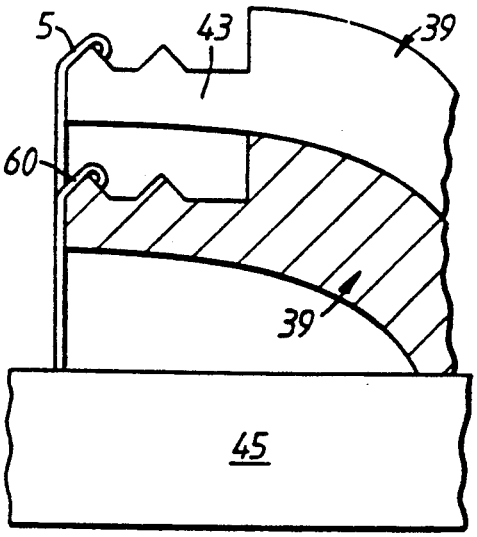
FIG. 9 is a side sectional view of the clip of FIG. 3 engaging with a pair of adjacent tiles.

FIGS. 8 and 9 show in detail the engagement of hooks (5) and (60) of the respective clips (1) and (10) with tiles (39).

Figure 10:
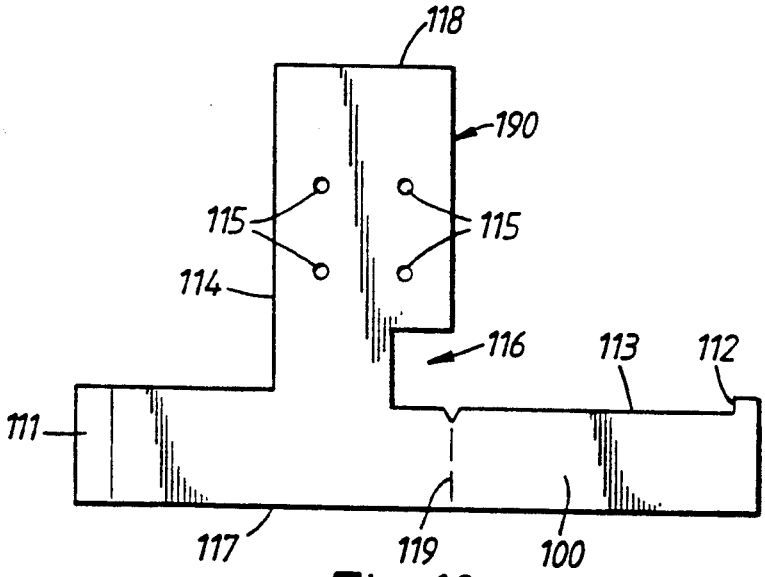
FIG. 10 is a plan view of a first embodiment of an apparatus constructed in accordance with the present invention.

Referring firstly to FIG. 10, the apparatus comprises a channel section (100) of pressed steel having a flared leading end (111) and an abutment (112) on the trailing end. The abutment (112) is formed by an opening (113) being formed in the flange of the channel section (100) and extending into the web of the channel section. A location line (119) with associated V-notch is formed in the upper surface of the channel section for the purpose of aligning the apparatus in the correct clip-driving location.

A substantially rectangular shaped steel outrigger plate (114) extends from the upper surface of the channel section (100) in the same plane. Openings (115) are provided through the outrigger to enable a clip-driving machine to be bolted thereon, with the clip-locating head being arranged in the U-shaped opening (116). The edge (190) of the outrigger is designed to be in direct alignment with the location line (119) so that a straight line may be scribed against it onto the batten upon which it rests. This sets the position for the apparatus to be aligned when clips are to be inserted in the succeeding batten.

The dimensions of the apparatus are carefully chosen so that the distance between the U-shaped opening (116) and the abutment (112) is equal to a conventional concrete roof tile clipping location, and the distance between the edge (117) of the channel section and the edge (118) of the outrigger is at least equal to the separation of adjacent battens when measured at their central longitudinal axes.

Figure 11:
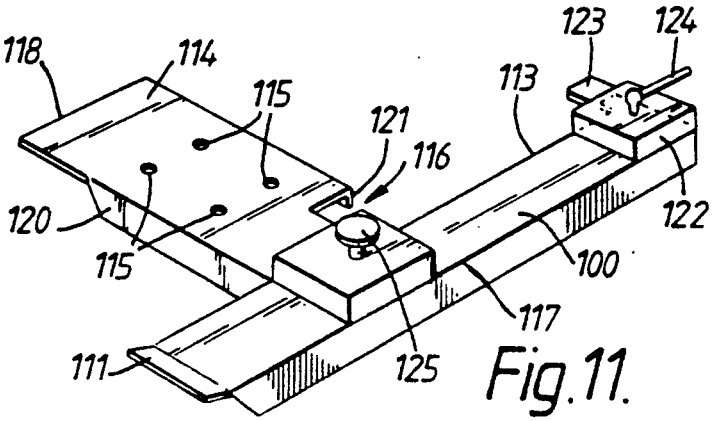
FIG. 11 is a top schematic view of a second embodiment of an apparatus constructed in accordance with the present invention.

The alternative embodiment of FIG. 11 shows like items to FIG. 10 similarly referenced. This embodiment, however, illustrates strengthening ribs (120), (121) formed at right angles, to the outrigger (114) and integral therewith, extending beneath the outrigger on opposite sides thereof. Also illustrated is a retractable stop comprising a housing (122) from which protrudes a spring-loaded tongue (123) and a latch (124). In normal use, the tongue (123) is biased to fully extend from the housing and to act as an abutment against which a tile clip abuts for alignment of the apparatus for driving the subsequent tile clip.

A further difference from the FIG. 10 embodiment is the provision of a hand rest (125) for aiding in the movement and control of the apparatus.

Figure 12:
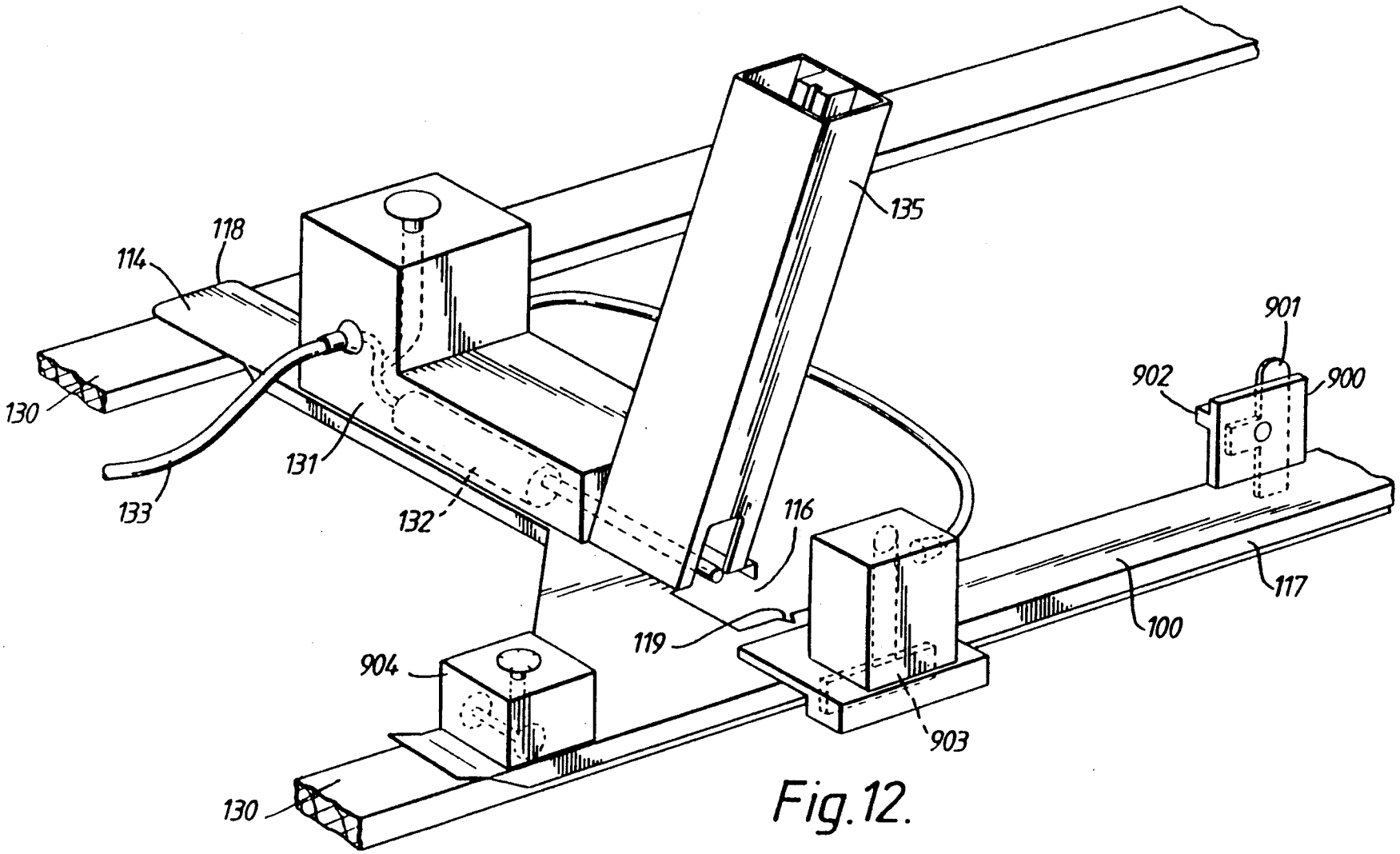
FIG. 12 is a top schematic perspective view of a combined third embodiment of an apparatus of the present invention and a clip-driving machine showing an in-use position.

FIG. 12 shows roofing battens (130) arranged at conventional spacings for concrete roof tiles. The apparatus and clip-driving machine combination is of unitary construction and the reference items on the apparatus are numbered similarly to that of previous figures. However, the retractable stop of FIG. 11 has been replaced by an upstand (900). An arm (901) is pivotally connected to the upstand (900) and a stop (902) extends from the upstand (900) to allow the arm (901) to pivot only in one direction. The clip-driving machine comprises a housing (131) in which is located a pneumatic cylinder (132) (dotted outline) connected to a compressed air supply (133). The compressed air supply (133) is also connected to a clamp (903) which, when activated, releasably secures the channel section (100) to the batten (130) to prevent excessive movement of the apparatus when a clip is driven home. A height adjusting means (904)—operated by any suitable conventional means—is also connected to the channel section (100) to allow the height of the channel section (100) above the batten (130) to be adjusted to allow for the slight variations in depth of adjacent tiles as the apparatus is moved along a batten. A triggering mechanism activates the pneumatic cylinder (132) which first activates the clamp (903) and then separates a clip from a stack within a cartridge (135) and finally drives it into the side of the batten (130).

Figure 13:
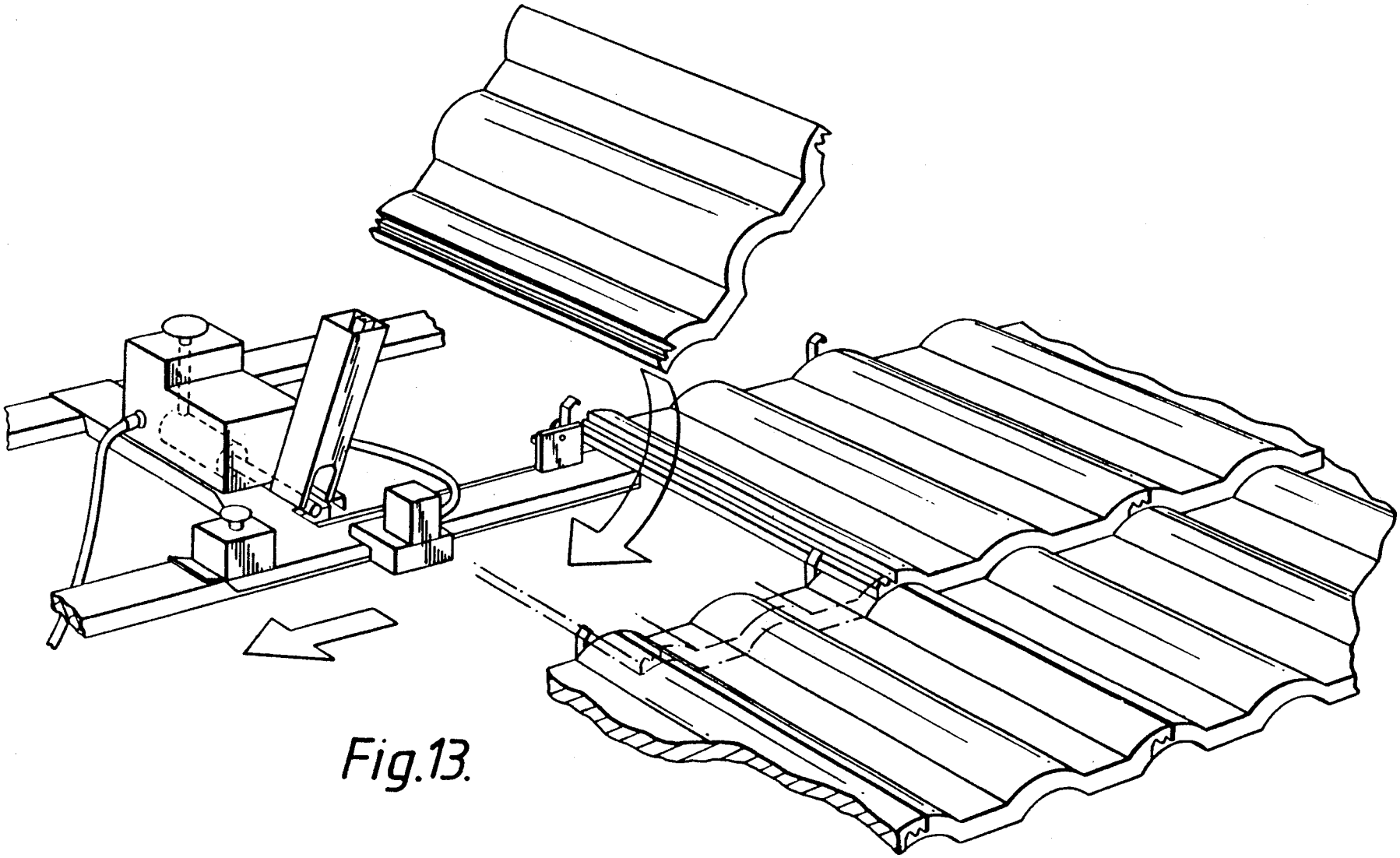
FIG. 13 is a top schematic perspective view of the combined apparatus and clip-driving machine of FIG. 12 in use after several tiles have been fitted.

In operation as illustrated in FIG. 13, the apparatus with attached clip-driving machine is positioned at one end of the first batten to be clipped, with the channel section overlying the first batten and the outrigger extending out over the second batten to be clipped. The location line on the channel section is then aligned to the exact location which has previously been determined to be where the first clip should be inserted. A marking is then made on the second batten to be clipped, against the scribe edge of the outrigger which is in alignment with the location line. The triggering mechanism is then activated and a clip is driven into the side of the first batten. The apparatus is then slid along the first batten until the location for the second clip in the first batten is reached. The triggering mechanism is once again activated and the second clip driven home. The process is repeated along the batten as many times as is necessary.

When it comes to inserting clips in the second batten, the apparatus with attached clip-driving machine is returned to the end of the roof adjacent to where the first clip was inserted, and the channel section is this time placed over the second batten with the outrigger extending to the third batten. The location line on the channel section is then aligned with the marking previously made on the second batten and a marking is made on the third batten against the scribe edge of the outrigger. The triggering mechanism is then activated and the entire process carried out in connection with the first batten is repeated.

From the foregoing it will be noted that the clip and apparatus of the invention have substantial advantages over the prior art.

These advantages of the present invention include 1) the clips can be manufactured from, for example, metal with a minimal of wasted material using conventional means such as by forming a plurality of tile blanks from a metal strip by passing through a punching or stamping apparatus to form the individual tile blanks and then subsequently passing each tile blank through a forming apparatus;

2) the clips can be produced extremely cheaply involving very little wastage of material;

3) the clip is much stronger in regard to deflection under load when compared to the prior tile clip as described previously; the clips surpass the regulatory standards and enables them to be manufactured from smaller gauge steel than has previously been possible;

4) the clip may also only installed in a single possible orientation; this simplifies installation procedures which may be carried out by an inexperienced person;

5) use of a cartridge of clips also speeds up installation time;

6) the clip may also be formed from light gauge metal which is in contrast with the prior tile clip; thus, for example, the tile clip of the invention may be formed from 0.8 mm thickness steel whereas the prior tile clip could only be satisfactorily formed from 1.2 mm thickness or greater;

7) the provision of shaped hooks (5) and (60) which, unlike adopting a shallow U shape as shown in Patent Specification 520403, comprise a web part abuting or bearing against the face of a ridge of a tile and a U-shaped portion part abuting or bearing against the inner face of the ridge has much greater holding strength than the prior clip discussed above which had a tendency to buckle when used in a similar situation;

8) by utilising the optional locating member with removable pre-set stop, the spacing of successive tiles can be adjusted such that, at the end of each tiling batten, the last tile to be fixed is a convenient fraction of a whole tile—for example, one half—and thus readily available;

9) row upon row of clips can expeditiously be inserted into the sides of roofing battens with minimum time and effort being involved; roofing tiles can then be simply clipped in place one after another with reduced chance of breakages.

Whilst the above has been given by way of illustrative examples of the invention, many modifications and variations may be made thereto by persons skilled in the art without departing from the broad scope and ambit of the invention as defined in the following claims.

I claim:

1. A clip for attaching two roof tiles or the like to a batten or similar member, said clip comprising:

(i) a rigid body;

(ii) first and second securing members, each said securing member depending from said rigid body in a first direction and adapted to engage respective side edges of said two roof tiles or the like; and (iii) a fastening member depending from said rigid body in a second direction opposite to said first direction and being adapted to secure said clip to said batten or similar member;

each said securing member comprising a shank terminating in a hook, each said shank having a portion thereof bent at an obtuse angle to form a linear web before terminating in said hook, and the shank of said second securing member being shorter than the shank of said first securing member.

2. A clip as defined in claim 1, wherein both said shanks lie in a common plane.

3. A clip as defined in claim 1 wherein said fastening member comprises a short shank bent orthogonally approximately at its mid-length.

4. A clip as defined in claim 3 wherein said orthogonal portion is crimped and has one edge thereof shaped to form a barb or the like.

5. A clip as defined in claim 1 wherein said obtuse angle is between 120° and 150°.

6. A clip as defined in claim 5 wherein said obtuse angle is 135°.

7. A clip as defined in claim 5 wherein each said linear web abuts or bears against a respective first of a ridge of said tiles and said hook abuts or bears against a respective second face of said ridge.

8. A clip for attaching a roof tile or the like to a batten or similar member, said clip comprising:

(i) a rigid body;

(ii) a single securing member depending from said rigid body in a first direction and being adapted to engage a side edge of said tile or the like; and (iii) a fastening member depending from said rigid body in a second direction opposite to said first direction and being adapted to secure said clip to said batten or similar member;

said securing member comprising a shank terminating in a hook, said shank having a portion thereof bent at an obtuse angle to form a linear web before terminating in said hook.

9. A clip as defined in claim 8 wherein said fastening member comprises a short shank bent orthogonally approximately at its mid length.

10. A clip as defined in claim 9 wherein said orthogonal portion is crimped and has one edge thereof to form a barb or the like.

11. A clip as defined in claim 8 wherein said obtuse angle is between 120° and 150°.

12. A clip as defined in claim 11 wherein said obtuse angle is 135°.

13. A clip as defined in claim 11 wherein said linear web abuts or bears against a first face of a ridge of said tile and said hook abuts or bears against a second face of said ridge.

14. A method of installing roof tiles or the like using a plurality of clips each comprising a rigid body; first and second securing members, each said securing member depending from said rigid body in a first direction and adapted to engage respective side edges of said roof tiles; and a fastening member depending from said rigid body in a second direction opposite to said first direction and being adapted to secure said clip to a batten; each said securing member comprising a shank terminating in a hook, each said shank having a portion thereof bent at an obtuse angle to form a linear web before terminating in said hook, and the shank of said second securing member being shorter than the shank of said first securing member, said method comprising the steps of:

attaching a plurality of said clips to a first tiling batten at spaced intervals thereof along the length of the batten;

subsequently laying a first row of tiles which are each supported by said first batten and wherein each tile is retained in a position by one of said securing members;

attaching a plurality of said clips to a second tiling batten at spaced intervals thereof along the length of the batten, said second tiling batten being oriented substantially parallel to said first tiling batten;

subsequently laying a second row of tiles which are each supported at one end by said second batten and at the other end by said first row of tiles, and wherein each tile of said second row is secured by the second of said securing members of said clip attached to said first tiling batten; and repeating the foregoing steps as necessary to affix all required rows of tiles.

15. A method of installing roof tiles or the like using a plurality of clips each comprising a rigid body; a single securing member depending from said rigid body in a first direction and being adapted to engage a side edge of a roof; and a fastening member depending from said rigid body in a second direction opposite to said first direction and being adapted to secure said clip to a tiling batten; said securing member comprising a shank terminating in a hook, said shank having a portion thereof bent at an obtuse angle to form a linear web before terminating in said hook, said method comprising:

attaching a plurality of clips to a tiling batten at spaced intervals thereof along the length of the batten;

subsequently laying a row of tiles which are each supported by said batten and wherein each tile is retained in position by said securing member; and repeating the foregoing steps as necessary to affix all required rows of tiles.

16. An apparatus for use in the installation of a roof tile clip or the like to a batten or similar member, said apparatus comprising:

a first section comprising a channel section adapted to straddle but being supported by a first batten; and a second section attached at one end to said first section and adapted at the other end to engage and be supported by a second batten adjacent and substantially parallel to said first batten, said second section being further adapted to support a clip-driving machine in a location enabling said clip to be driven into first batten;

said second section comprising an outrigger arranged to extend from said channel section to overlie said second batten, said channel section having at least one of its flanges cut away between its ends on the side from which the outrigger extends to form a recess, said outrigger being adapted to support said clip-driving machine in a location enabling clips to be driven into said first batten through said recess;

said outrigger comprising a substantially flat plate formed integrally with the top surface of said channel section of substantially overall rectangular configuration with strengthening ribs to prevent buckling under the weight of the clip-driving machine, said strengthening ribs comprising edge portions which extend downwards at right angles to the plane of said plate, the length of the outrigger being such that it is adequately supported by the second or adjacent roofing batten and is readily slidably thereover; and the outrigger including, at the junction of the outrigger and channel sections, a recessed portion which is substantially U-shaped when viewed from above, with the driving mechanism of said machine being located on one arm or side of the U and the batten to which the clip is to be attached being located directly beneath the other arm of the U.

17. An apparatus as defined in claim 16 wherein a cut-away is provided in the web of the channel section adjacent to said cut-away in the flange, and extending the same distance as said cut-away in the flange but being of only minimal depth.

18. An apparatus as defined in claim 16 further comprising a retractable stop adjacent the end of the channel section remote from the location of the clip driving machine, comprising a plunger member which is normally spring-biased to extend from a housing fitted to the top surface of the channel section substantially at right angles to the said channel section with an associated button or lever which may be substantially to withdraw the plunger into the housing so that the plunger does not extend past the flange of the channel section.

19. An apparatus as defined in claim 16 further comprising a pivotable arm adjacent the end of the channel section remote from the clip-driving machine, whereby said pivotable arm is constrained to pivot in only one direction whereupon contact with a driven clip causes the arm to pivot upwards enabling the apparatus to be slid past the clip and engagement of the arm with the other side of the driving clip provides a rigid abutment for accurate placement of the apparatus.

20. An apparatus as defined in claim 16 further comprising a locating member as part of, or adjacent to, the end of the channel section remote from the location of the clip-driving machine, said locating member including a stop comprising a removable pre-set positioning member which allows the distance between successive clips to be varied accordingly to a predetermined spacing.

21. An apparatus as defined in claim 16 wherein the leading edge of the channel section includes a flared end.

22. An apparatus as defined in claim 16 further comprising an adjusting means for allowing the height of the channel section above the batten to be varied.

23. An apparatus as defined in claim 16 further comprising a clamping means for releasably securing the channel section to the batten to avoid excessive movement of the apparatus when each clip is driven home.

* * * * *